US005534295A

United States Patent [19]

Schlichter et al.

[11] Patent Number: 5,534,295

[45] Date of Patent: Jul. 9, 1996

[54] POLYUREA/POLYURETHANE EDGE COATING AND PROCESS FOR MAKING

[75] Inventors: Mark E. Schlichter, Chippewa Falls; Mark S. Barton, Black River Falls, both of Wis.

[73] Assignee: August Lotz Co., Inc., Boyd, Wis.

[21] Appl. No.: 210,999

[22] Filed: Mar. 21, 1994

[51] Int. Cl.[6] ..... B05D 1/02; B05D 3/10; B05D 7/08

[52] U.S. Cl. ..... 427/284; 427/300; 427/422; 427/397; 427/291

[58] Field of Search ..... 427/300, 284, 427/422, 408, 291, 397; 118/410, 411, 415

[56] References Cited

U.S. PATENT DOCUMENTS

| | | | |
|---|---|---|---|
| 2,000,226 | 5/1935 | Fry | 427/300 |
| 2,102,089 | 12/1937 | Perrin | 427/300 |
| 2,219,381 | 10/1942 | Codwise | 427/300 |
| 2,713,364 | 7/1955 | Smith | 427/291 |
| 2,745,129 | 5/1956 | Johnson | 427/358 |
| 2,772,986 | 12/1956 | Buck | 427/408 |
| 3,071,106 | 1/1963 | Burelbach et al. | 118/410 |
| 3,362,379 | 1/1968 | Knudtson | 118/411 |
| 3,595,203 | 7/1971 | Fabulich | 118/415 |
| 3,808,030 | 4/1974 | Bell | 427/496 |
| 3,907,624 | 9/1975 | Gravely, Jr. | 156/245 |
| 3,908,043 | 9/1975 | Evans et al. | 427/408 |
| 3,967,581 | 7/1976 | Zirbel | 118/684 |
| 4,009,307 | 2/1977 | Erikson et al. | 427/377 |
| 4,345,044 | 8/1982 | Columbus et al. | 523/220 |
| 4,390,564 | 6/1983 | Kimble | 427/401 |
| 4,663,201 | 5/1987 | House et al. | 427/388.2 |
| 5,116,639 | 5/1992 | Kolk et al. | 427/284 |
| 5,147,486 | 9/1992 | Hoffman | 156/154 |
| 5,160,766 | 11/1992 | Waltrip et al. | 427/422 |
| 5,171,818 | 12/1992 | Wilson | 528/59 |
| 5,179,141 | 1/1993 | Emery et al. | 427/284 |
| 5,266,671 | 11/1993 | Primeaux | 528/68 |
| 5,286,547 | 2/1994 | Tyerman | 428/195 |
| 5,290,603 | 3/1994 | Nielsen et al. | 427/422 |
| 5,308,657 | 5/1994 | Markusch et al. | 427/284 |

FOREIGN PATENT DOCUMENTS

| | | |
|---|---|---|
| 0420420A2 | 4/1991 | European Pat. Off. . |
| WO86/05795 | 10/1986 | WIPO . |

*Primary Examiner*—Diana Dudash
*Attorney, Agent, or Firm*—Richard C. Litman

[57] ABSTRACT

Polyurea/polyurethane coatings can be applied in situ to the edges of substrates without the need for adding any additives to increase flowability or moldability. The in situ application utilizes the extremely fast cure time of polyurea/polyurethanes to provide a method for efficiently creating an article with a protected edge coat by spray applying polyurea/polyurethane to wood substrates. The polyurea/polyurethane will adhere solidly to the substrate, and is applied with sufficient thickness to provide resistance to chemical, environmental, or physical stresses perpendicularly and angularly directed at the edge. The method utilizes a spray gun at high temperature and pressure, combining isocyanate and amine components of the polyurea/polyurethane coating at the nozzle and impinging the combined components onto the edge to be treated. The product of this process gives off no volatile organic compounds (VOCs), is odor free, peel resistant, and sterilized.

7 Claims, 3 Drawing Sheets

POLYUREA/POLYURETHANE EDGE COATING AND PROCESS FOR MAKING

BACKGROUND OF THE INVENTION

1. Field of the Invention

The present invention relates generally to a method for edge coating wood substrates and the resulting product. More specifically, the present invention relates to the coating of edges of wood substrates with a sprayable polyurea/polyurethane elastomer to produce a durable synthetic guard.

2. Description of the Prior Art

Wood substrates, including solid wood, and wood composites such as plywood, particle board, fiberboard, and the like have been used to provide flat horizontal surfaces for tables, countertops, chair seats, furniture tops, and other everyday surfaces for most of civilized history. One problem that has always accompanied their use is the wear and abuse that edges of these surfaces bear. For purposes of the present invention, an edge is defined as the exposed periphery bounded by a given substantially planar top surface and a substantially planar bottom surface. Edges may be flat, curved, or faceted.

Conventionally, the treatments of edges on these substrates has been predominantly the same as at least the top surface. Along these lines, if protection is to be afforded to an edge, shaped tops, such as those disclosed by U.S. Pat. No. 5,286,547 to Tyermann are typically used. This reference discloses the use of synthetic coating materials for the protection of an element of furniture, including edges. These coatings are applied to synthetic sheets which have been molded for a contour of the element, rather than directly applied to the edges, such that the portion of the coating which covers the edge of the underlying substrate is a continuous extension of the top. Though somewhat effective in providing protection to the substrate, these types of coatings are usually themselves not durable, since flowability and formability to various configurations are inherent in the materials chosen.

Prefabricated guards for the protection of edges are also known in the art. Typically, these are made of metal or plastics and must be attached to the edge, or to a portion of the top or bottom surface. Screws, nails, T-molds or adhesives are conventionally used. This type of edge guard has several disadvantages. The appearance of mechanical attachments detracts from the aesthetic appearance of the article made, whereas adhesive or T-molded attachments lack stability and durability. Further, premanufactured edge guards are limited to use on substrates of matching dimension.

Methods for applying coatings of polyurea/polyurethanes through spray application of amine/polyol-isocyanate reaction products have been the subject of earlier patents. For example, U.S. Pat. No. 5,266,671 to Primeaux, II discloses an abrasion resistant sprayable polyurea elastomer. These polyureas are the reaction products of isocyanates and amines applied under high pressure and temperatures. This patent reference additionally requires the use of a particulate filler. Similarly, EP 0420420 teaches a sprayable elastomer which may be either a polyurethane or a polyurea, but does not require fillers. Both disclosures are herein incorporated by reference. Neither reference discloses edge treatment of any substrate with polyureas. Further, these patents focus on increasing the flowability and moldability of polyurea/polyurethanes while maintaining the durable qualities of polyurea/polyurethanes. Accordingly, chain extenders, and in the case of U.S. Pat. No. 5,266,671, reinforcing fillers are used.

U.S. Pat. No. 4,009,307 to Erikson et al. discloses the use of isocyanate-terminated quasi prepolymers in the production of polyurea-polyurethane coatings. These coatings are taught to display excellent chemical and physical properties on wood substrates. These coatings may be optionally pigmented and spray applied. U.S. Pat. No. 4,663,201 discloses another polyurea coating which may be used on wood substrates. This patent requires the use of trifunctional isocyanates. U.S. Pat. No. 5,171,818 to Wilson discloses another sprayable polyurea-polyurethane coating which requires the use of aliphatic polyisocyanates. Again, no edge treatment is disclosed in any of these patents.

WO 86051795 to Turner et al. discloses the use of isocyanate-terminated quasi prepolymers in the production of polyureas. U.S. Pat. No. 5,160,766 to Waltrip et al. discloses a process for applying a coating composition at high temperatures (65–120 degrees F.) and pressures (about 2,750 psi). The spray process produces a coating for various substrates, though wood is preferred. This reference does not specifically teach the use of polyurea/polyurethanes, nor does it teach any edge treatment.

None of the above inventions and patents, herein incorporated by reference, taken either singly or in combination, is seen to describe the instant invention as claimed.

SUMMARY OF THE INVENTION

It has been unexpectedly found that polyurea/polyurethane coatings can be applied in situ to the edges of substrates without the need for any additives to increase flowability or moldability. Accordingly, the advantages of polyurea/polyurethane elastomers are inherently rather than artificially maintained. Further, the in situ application according to the present invention utilizes the extremely fast cure time of polyurea/polyurethanes to an advantage, rather than the trend in the art which seeks to slow the curing time. The present invention provides a method for efficiently creating a edge coat by spray applying a polyurea/polyurethane coating to edges of wood substrates. The polyurea/polyurethane will adhere solidly to the substrate, and is applied with sufficient thickness to provide structural protection from not only chemical, environmental, or physical stresses perpendicularly directed at the edge, but also from various angles. The method utilizes a spray gun at high temperature and pressure, combining isocyanate and amine components of a polyurea coating, and/or isocyanate and polyol components of a polyurethane at the nozzle and impinging the combined components onto the edge to be treated. The product of this process gives off no volatile organic compounds (VOCs), is odor free, peel resistant, and sterilized.

Accordingly, it is a principal object of the invention to provide a method for coating the edges of wood substrates with a polyurea/polyurethane elastomer.

It is another object of the invention to provide a protective table top edge coating which is very stable under extreme temperature conditions and resists chipping or peeling.

It is a further object of the invention to provide a process, and a product of that process which are inexpensive, dependable and fully effective in accomplishing their intended purposes.

These and other objects of the present invention will become readily apparent upon further review of the following description and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
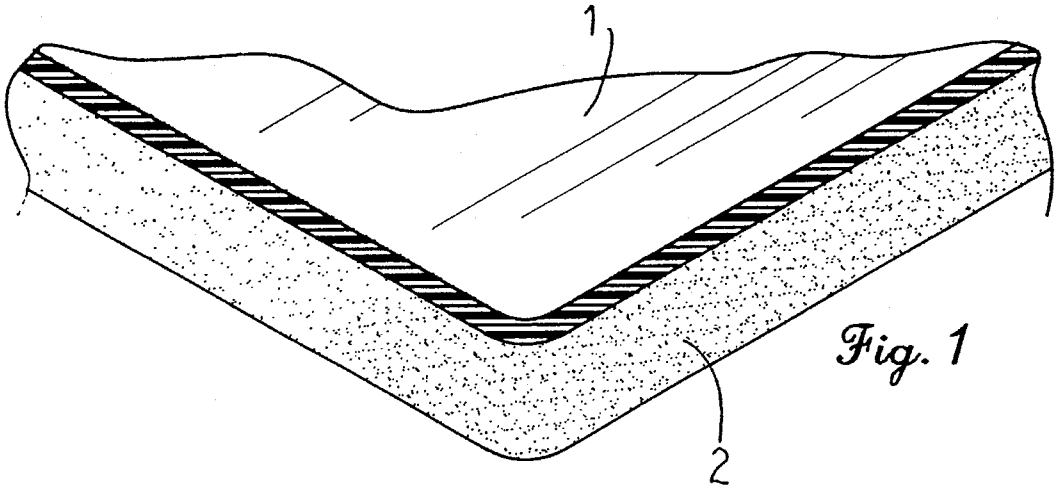
FIG. 1 is a partial perspective view of a table top with an edge coating according to the present invention.
Figure 3:
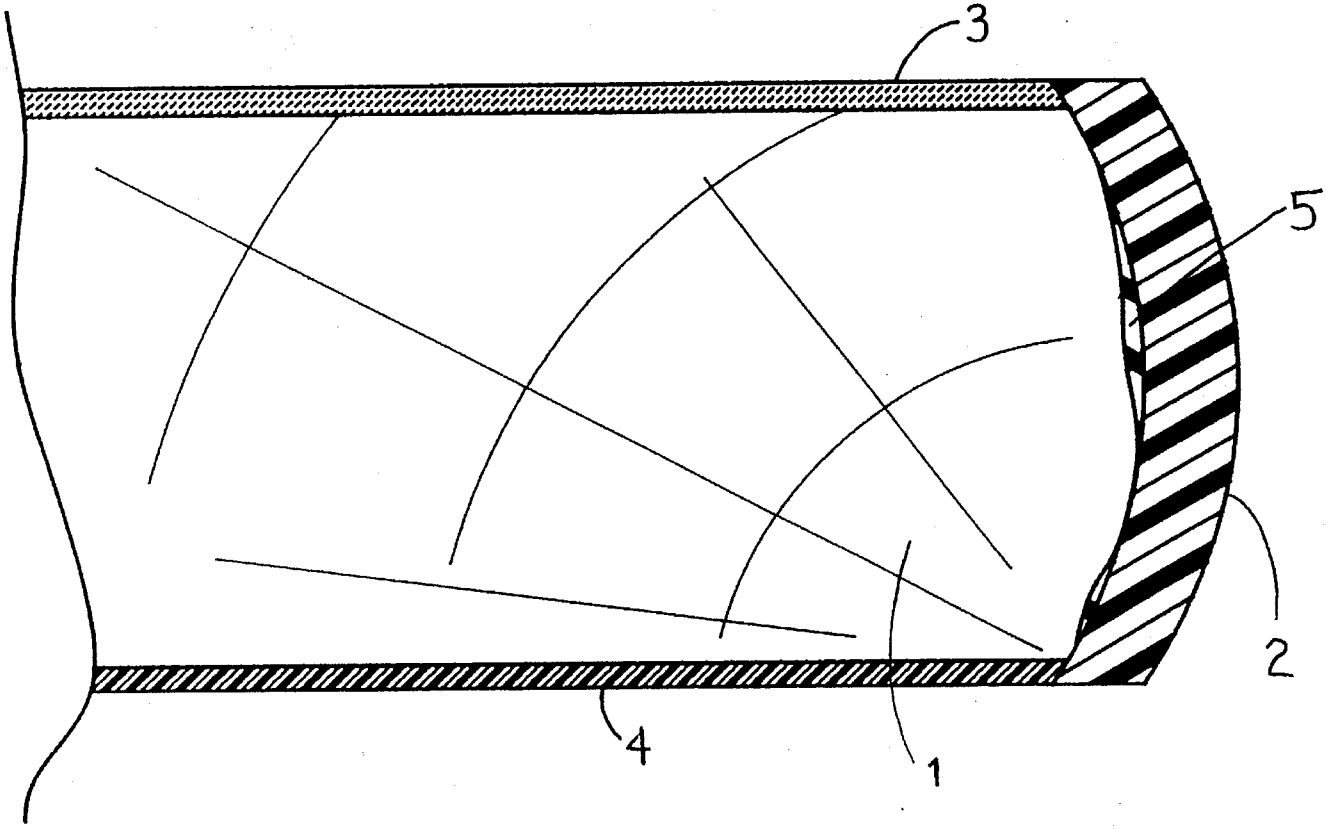
FIG. 3 is a side cutaway showing an edge coating according to the present invention on the edge of a wooden substrate.

With reference to the drawings, the present invention includes a method for making an edge protected article by coating an edge of a wooden substrate 1 with an elastomer 2, as best seen in FIGS. 1 and 3. Appropriate wooden substrates for the purposes of the instant invention are solid wood and wood composites such as plywood, fiberboard, and particle board. The substrate preferably has substantially planar top and bottom surfaces, and an edge defined by the exposed periphery bounded by the top surface and the bottom surface. Preferred substrates include those which have prelaminated top surfaces 3 and/or base plates 4 on the bottom surfaces, as well as painted or otherwise coated wood.

Figure 4:
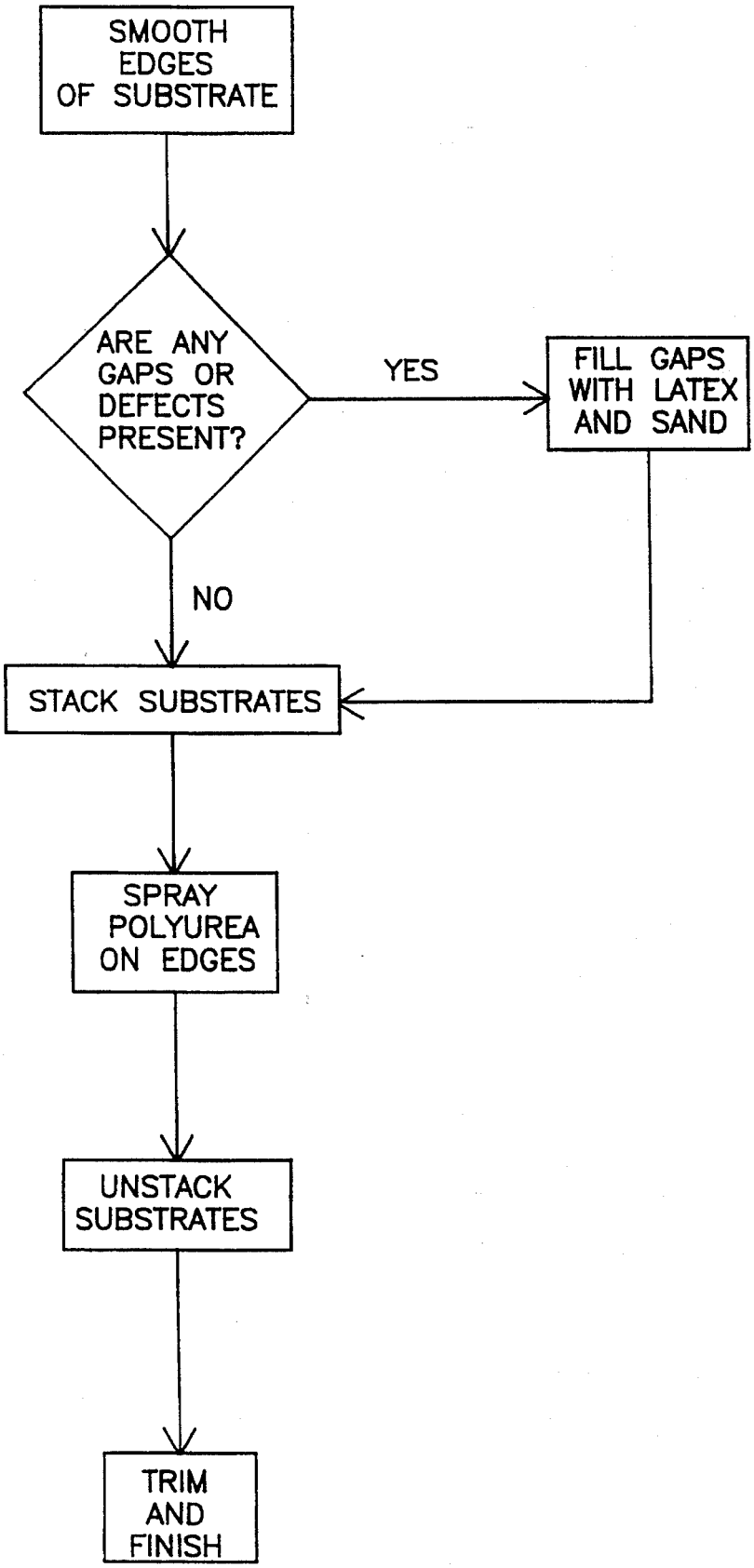
FIG. 4 is a flow chart outlining steps of a process according to the present invention.

A preferred embodiment of the present process for producing the edge protected article is outlined in FIG. 4. The edge of a substrate is first smoothed so that the contour of the desired edge coating is evident. For some substrates, only fine sanding may be necessary. For substrates such as hardwood, plywood, particle board, or fiber board, a first sanding step followed by filling any imperfections in the substrate, and a final sanding step may be necessary. Preferably a filler 5 such as a latex adhesive is used to fill any gaps or defects present. When fillers are used, it is important that the final sanding step reveal the substrate at the edge for a majority of the edge area, such that the coating will for the most part be directly to the substrate, as shown in FIG. 3.

Figure 2:
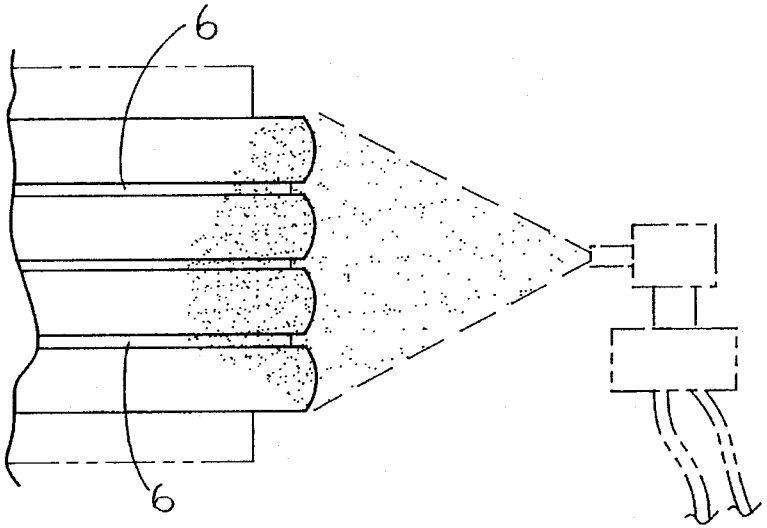
FIG. 2 is side view showing the spray application step of the present invention.

Once the edge is prepared, the substrates are ready for application of the polyurea edge coat. Individual substrates may be used. Preferably, several substrates are stacked one on top of another such that the edges of each are substantially vertically aligned, as shown in FIG. 2. A thin spacer 6 may be placed between each substrate separating the top surface of one substrate from the bottom surface of another. The spacer may be made of any thin strong sheet material. Preferred spacers can be made of hard plastic laminates of about 0.040 inches thick, and are placed such that they are slightly recessed from the edge of the overlaid substrates by as much as 0.5 inches.

The substrate or stack of substrates is then edge sprayed with a polyurea elastomer to form a coating. Polyureas and polyurethanes suitable for the present invention include any of the isocyanate-amine or isocyanate-polyol reaction products known in the art such as those detailed in the above patents whose disclosures have been presently incorporated. Preferably, the polyurea, polyurethane, or mixtures thereof is an impinged product of two component streams, A and B. Component stream A preferably contains soft block quasi-prepolymers of partially reacted polyfunctional aromatic or aliphatic isocyanates, and component stream B preferably contains polyetheramines and/or polyols and optional amine chain extenders. If desired a pigment may be used in one of the streams. Advantageously, no additives are necessary to slow the curing of the polyurea/polyurethane, nor any counteractive rigidifying fillers.

Component streams A and B are most preferably brought together and quickly applied utilizing a high pressure, high temperature spray gun. A pressure of between about 1400 and 2500 psi and a temperature of between about 120 and 170 degrees Fahrenheit may be used, preferably a pressure of 1800 to 2200 psi and a temperature of about 150–160 degrees Fahrenheit. A pressure of about 2000 psi and a temperature of about 160 degrees Fahrenheit has been found to be ideal in the present process for a wide variety of polyurea formulations.

A preferred spray gun for use with present invention is a GUSMER Model GX-7, wherein the component streams are combined at the nozzle of the gun. The polyurea/polyurethane is preferably applied in short bursts or strokes from the spray gun through multiple passes over any given edge area. The finish of the edge coating is dependent to some extent by the distance of the spray gun nozzle to the edge of the substrate. The further the distance between the gun and the substrate, the more particulate and/or grainy the coat will become. Useful coatings may be acquired when the gun is positioned at a distance of between about 15 and 50 inches from the substrate edge. Preferably, the distance is initially between about 15 and 20 inches thereby giving a very smooth coat against the bare substrate. If a textured surface is desired, this distance may be increased to between about 40 and 50 inches after the initial passes and the desired thickness is achieved. Further, by applying very short bursts of elastomer at this increased distance, the texture of the surface may be enhanced.

Once the coat has been applied to a thickness of between about 0.010 and 0.5 inches, preferably around 0.060 inches, the spraying is discontinued. Polyurea/polyurethane sets extremely quickly such that in between 5–7 seconds the coating is tack free, and at 15 seconds it is at a workable cure. Final hardness is achieved within approximately 24 hours.

If multiple substrates had been stacked together, the recessed spacers will allow the articles to be separated. The coating may then be trimmed and any overspray removed.

It is to be understood that the present invention is not limited to the sole embodiment described above, but encompasses any and all embodiments within the scope of the following claims.

We claim:

1. A method for making edge protected articles by coating edges of wooden substrates, said method comprising the following steps:

a) smoothing the edges to be coated by sanding;

b) aligning the edges to be coated by stacking the wooden substrates with a spacer placed between each pair of adjacent substrates adjacent the edges to be coated;

c) spraying the edges with an elastomer to form a durable protective coating resistant to chipping and peeling, said elastomer selected from the group consisting of polyureas, polyurethanes, and mixtures thereof, said step of spraying utilizing a spray gun to form at a nozzle a solventless mixture comprising a first polyisocyanate component and a second component selected from the group consisting of an amine and a polyol;

d) trimming the coating to remove any excess coating or overspray.

2. The method according to claim 1, wherein said elastomer is spray applied under a pressure of between about 1400 and 2500 psi and a temperature of between about 120 and 170 degrees Fahrenheit.

3. The method according to claim 2, wherein said elastomer is spray applied under a pressure of 1800 to 2200 psi and a temperature of about 150–160 degrees Fahrenheit.

4. The method according to claim 3, wherein said elastomer is spray applied under a pressure of 2000 psi and at 160 degrees Fahrenheit.

5. The method according to claim 1, wherein said elastomer is applied in multiple passes using a spray gun positioned at a distance of between about 15 and 50 inches from the substrate edge.

6. The method according to claim 5, wherein said distance is initially between about 15 and 20 inches, and is increased to between about 40 and 50 inches through the course of said multiple passes.

7. The method according claim 17, wherein the step of smoothing the edges to be coated includes applying a filler to any voids in the edges.

* * * * *